United States Patent [19]

Zdanys, Jr. et al.

[11] Patent Number: 4,620,077

[45] Date of Patent: Oct. 28, 1986

[54] INTEGRAL SWITCH CONNECTOR WITH REMOTE ACTUATOR

[75] Inventors: John Zdanys, Jr.; Tony J. Zaderej; Matthew A. Robbins, all of Elkhart, Ind.

[73] Assignee: CTS Corporation, Elkhart, Ind.

[21] Appl. No.: 703,197

[22] Filed: Feb. 19, 1985

[51] Int. Cl.[4] ..... H01H 17/08

[52] U.S. Cl. ..... 200/331; 74/97; 74/501 P; 403/331; 200/68.3; 200/51 R; 200/153 LA; 200/159 A; 200/339; 200/293; 200/305

[58] Field of Search ..... 200/329, 161, 330–332, 200/337, 339, 153 LA, 51 R, 51.09, 293, 68.3, 159 A, 153 G, 153 F, 283, 340, 304, 305; 74/100 R, 100 P, 97, 501 R, 501 P; 403/331

[56] References Cited

U.S. PATENT DOCUMENTS

| | | | |
|---|---|---|---|
| 1,582,757 | 4/1926 | Jines | 403/331 |
| 1,666,639 | 4/1928 | Cadieux | 200/331 X |
| 1,899,846 | 2/1933 | Boyd | 403/331 |
| 2,614,197 | 10/1952 | Lightfoot | 200/331 |
| 2,659,791 | 11/1953 | Dickinson | 200/331 X |
| 2,868,967 | 1/1959 | Poppa et al. | 200/331 X |
| 3,043,120 | 7/1962 | Waldron | 74/501 P |
| 3,643,046 | 2/1972 | Zdanys et al. | 200/76 |
| 3,764,779 | 10/1973 | Kadoya et al. | 74/501 P X |
| 3,843,853 | 10/1974 | Panek et al. | 200/51.09 |
| 3,996,431 | 12/1976 | Brown | 200/16 C |
| 4,079,220 | 3/1978 | Wagner et al. | 200/159 R |
| 4,081,641 | 3/1978 | Piber | 200/153 LA |
| 4,137,438 | 1/1979 | Sato et al. | 200/153 H |
| 4,150,272 | 4/1979 | Bruun et al. | 200/159 A |
| 4,234,769 | 11/1980 | Brandt et al. | 200/67 DB |
| 4,339,643 | 7/1982 | Murmann | 200/159 A |
| 4,340,793 | 7/1982 | Kirchoff | 200/268 |
| 4,389,551 | 6/1983 | Deibele et al. | 200/51 R |

*Primary Examiner*—Stephen Marcus
*Assistant Examiner*—Ernest G. Cusick
*Attorney, Agent, or Firm*—Rodger H. Flagg

[57] ABSTRACT

An integral switch connector with remote actuator has a plurality of conductive terminals disposed within a switch housing. A slide member is remotely biased to make or break contact between contact arms to switch voltage between terminals. A connector disposed within switch housing provides connection to a remote apparatus. The remote actuator has a snap-action feature, to bias the slide member independently of the speed of movement of the manual biasing means. Movement of the actuator assembly biases a non-conductive actuator rod disposed within a non-conductive sleeve, to bias the slide member within the switch housing to make or break electrical communication between terminals. A spring disposed between the slide member and the switch housing breaks electrical contact between terminals should the actuator rod fail. A link coupling provides a removable connection between rod and sleeve at a location between actuator and switch assemblies.

20 Claims, 13 Drawing Figures

8
15
21
30
32
34
18
28
38
36
24
22
6
10
26
36
38
19
23
25
23
150
82
48
40
46
44
17
16,14
20
12
42
46
44
80

16
14
55
52
50
15
10
57
59
18
30
32
60
62
66
66
53
21
58
58
56
70
72
73
22
18
26
24
38
38
36
36
28

55
16
14
52
60
57
50
10
59
15
62
18
30
32
21
53
58
66
66
70
56
7
7
72
72
73
70
26
18
22
28
24
38
38
36
36

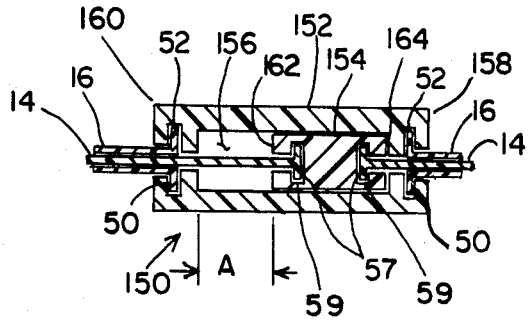
FIG. 9
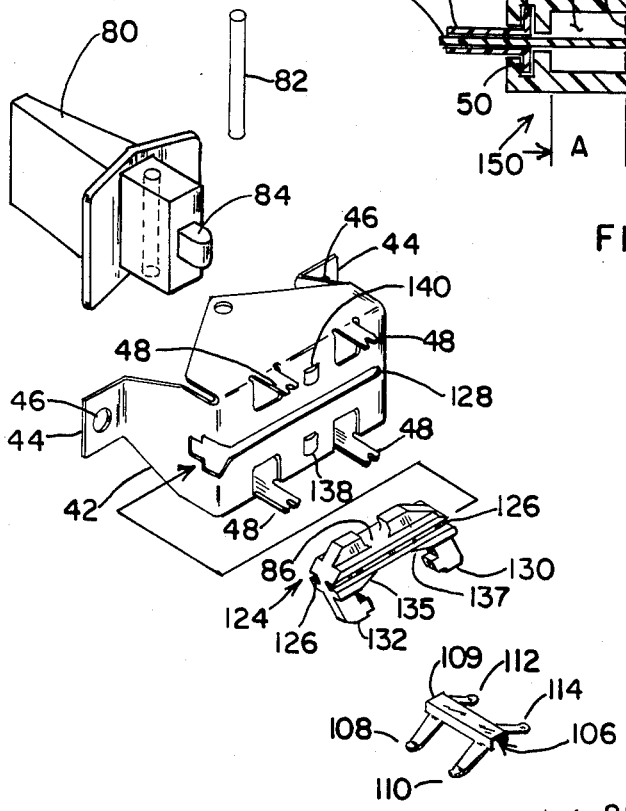
FIG. 8
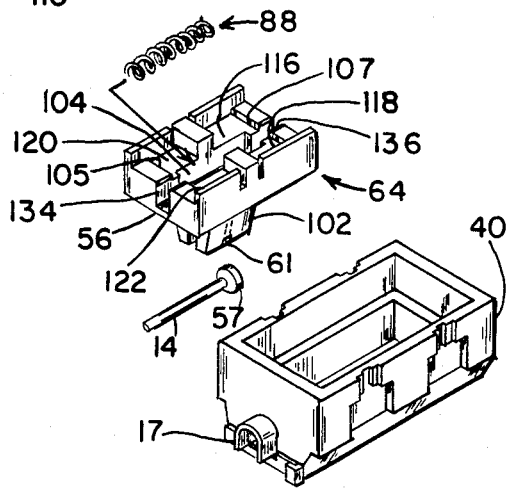

INTEGRAL SWITCH CONNECTOR WITH REMOTE ACTUATOR

BACKGROUND OF THE INVENTION

This invention relates to an integral switch connector having remote actuation.

There are numerous applications where it is desirable to provide an integral switch connector at a position remote from the manual actuating means. On control panels, or vehicle dash boards, it is often desirable to isolate electrical voltage from the manual actuating means.

Higher voltage switching, such as 120 VAC or 240 VAC switching often causes R.F.I. (Radio Frequency Interference) or E.M.I (Electromagnetic Intereference) shielding problems when routed in proximity to sensitive electronic equipment, such as computers, or the like. To avoid shielding problems, some electronic component manufacturers place their power switch to the rear of their equipment, in close proximity to the power cord input to the device. This is inconvenient to the operator of such equipment, requiring the operator to reach to the rear of the equipment to turn the equipment on or off. Many equipment operating environments restrict access to the rear of the equipment, complicating placement of such equipment in these environments. Many other applications prefer use of an integral switch connector with remote actuator, especially where danger of electrical shock is inherent in the design application, such as when a switch is used to actuate an electrical device in close proximity to water.

The present invention uses a remote actuator to transmit manual movement of an actuator arm to bias a non-conductive rod within a non-conductive sleeve to remotely bias an integral switch connector, eliminating the need for RFI and EMI shielding along the non-conductive rod and sleeve, while eliminating the hazzard of electrical shock in proximity to the remote actuator.

Switching contacts for use on direct or alternating current are preferably designed so that the switching mechanism will trip free of the actuating member during switch actuation so that the switch will make or break circuit connection with a quick snap action by the switching blade whose rate of motion during switching is not affected by manipulation of the actuation means. Such switching means are known to the art as snap action switches. One such snap action switch is disclosed in U.S. Pat. No. 3,643,046; while yet another is disclosed in U.S. Pat. No. 4,079,220.

Power receptacle switches are exemplified in the following U.S. Pat. Nos. 4,081,641; 4,398,551; 4,340,793; 4,137,438; 4,234,769 and 4,079,220.

U.S. Pat. No. 3,996,431 discloses a remote switch, while U.S. Pat. No. 3,843,853 discloses a cable actuated remote switch.

SUMMARY OF THE INVENTION

Therefore, one object of the present invention is to provide an improved integral switch connector having remote actuation.

Another object is to provide a novel integral switch connector with contact arms movable between first and second operative positions, wherein the speed of movement of the contact arms is independent of the speed of movement of the remote actuating means.

Another object is to dispose a resilient member between the switch housing and the switch slide member, to bias the first slide member to break electrical contact between the contact arms and the first terminals, should the actuator rod fail.

Another object is to provide a novel means to operatively secure the retaining sleeve to the switch housing.

Yet another object is to provide a novel means to operatively secure the actuator rod to the slide member.

Still another object is to combine a switch and connector into a novel integral switch connector having remote actuation.

A further object of the invention is to provide an improved integral switch connector with remote actuator embodying any combination of the aforementioned objects.

These and other objects of this invention will be apparent to one of average skill in the art, from the disclosure of the following drawings, specifications and claims.

BRIEF DESCRIPTION OF THE DRAWINGS

FIG. 8 is an exploded view of the preferred snap-action actuator assembly.

FIG. 9 is a cross sectional view of an in-line removable link for selectively separating the actuator rod and sleeve.

DESCRIPTION OF THE PREFERRED EMBODIMENT

Figure 1:
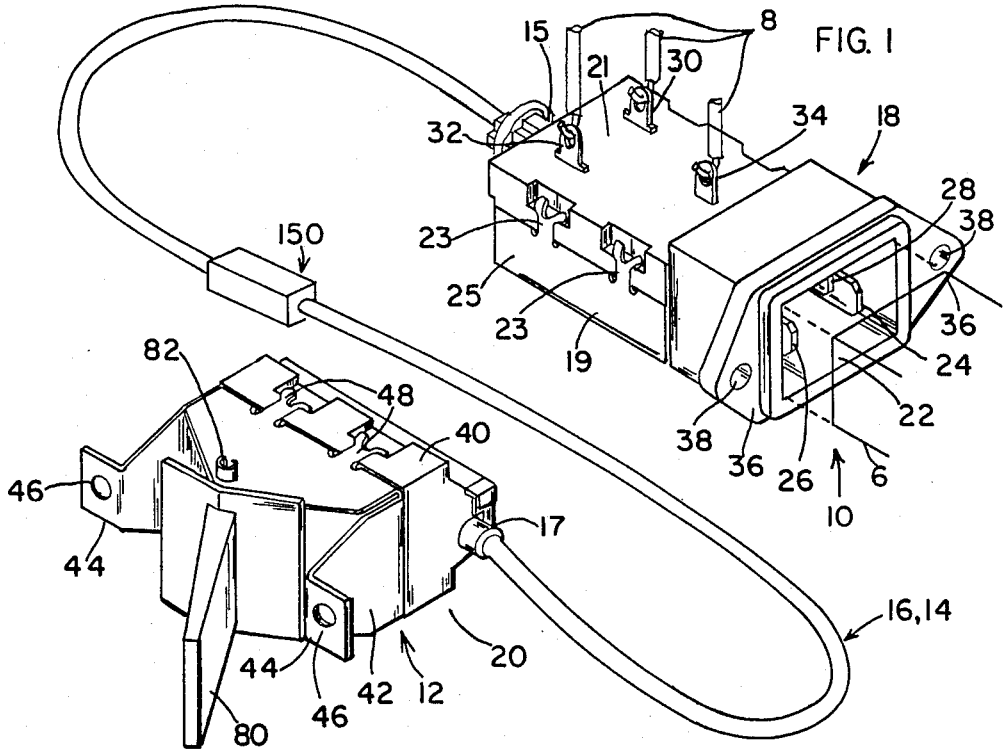
FIG. 1 is a perspective view of the assembled integral switch connector with remote actuator.

The above mentioned and other features and objects of this invention and the manner of attaining them will become more apparent and the invention itself will be best understood by reference to the following description of the invention taken in conjunction with the accompanying drawings wherein:

FIG. 1 is a perspective view of the integral switch connector assembly 10 with remote actuator assembly 12 coupled by an elongated flexible, non-conductive actuator rod 14 slideably received within an elongated flexible, non-conductive retaining sleeve 16. Sleeve 16 is joined at switch end 15 to a switch housing 18, and at actuator end 17 to a remote actuator housing 20.

The switch housing 18 preferably has a non-conductive receptacle connecting end 22 disposed within switch housing 18. Receptacle connecting end 22 has a first plurality of conductive terminals with external prongs 24, 26, 28 adapted to receive a female socket 6 from a remote source.

A second plurality of conductive terminals 30, 32, 34 are disposed within a non-conductive portion of the switch housing 18, and are preferably adapted with solder terminals extending beyond housing 18 for soldering to external electrical connections, such as electrical wires 8.

It should be noted that the first and second terminals herein disclosed may readily be adapted for male, female, spade, solder, flow solder, or other conventional terminal connection means to suit compatibility with other equipment in electrical communication with the disclosed switch assembly 10. It should be noted that the quantity of terminals shown is exemplary, and may vary according to the application without departing from the scope of the disclosed invention.

Where one or more first or second terminals are to be soldered to an external electrical connection or flow soldered to a substrate such as a printed circuit board (not shown), it is preferred to mold part 21 of switch housing 18 of a temperature resistant material such as a thermoset plastic, to resist damage to part 21 of housing 18 during the soldering operation. Switch housing 18 preferably extends beneath part 21 to enclose contact arms 60, 62 therebetween. A mounting flange 36 with mounting apertures 38 therethrough, is preferably positioned to secure the switch assembly 10 to a suitable mounting surface (not shown) by conventional means.

A switch cover 25 may be formed to surround a portion of housing 18, located beneath part 21, and cover 25 may be secured to part 21 with a plurality of tabs 23 as shown in FIG. 1; or parts 18, 21 may be secured to each other by other conventional means, such as glueing or sonic or vibration welding. Parts 18, 21 are preferably formed of a non-conductive material, to isolate first and second terminals 24, 26, 28 and 30, 32, 34 therein.

The remote actuator housing 20 is preferably made in two parts 40, 42 which may be fabricated of any suitable material, regardless of conductivity. Non-conductive actuator rod 14 and non-conductive retaining sleeve 16 totally isolate remote actuator 12 from switching current passing through first or second terminals 24, 26, 28, 30, 32, 34.

As shown in FIG. 1, part 40 of remote actuator 12 is preferably molded for ease of fabrication, while part 42 is preferably formed to provide mounting flanges 44, with mounting apertures 46 therethrough. Formed tabs 48 are preferably used to secure part 42 to part 40 at assembly, or parts 40, 42 may be secured to each other by other conventional means.

External retaining sleeve 16 is preferably fabricated from a flexible, non-conductive tubular thermoplastic material with an external annular sleeve flange 50 formed on at least one end by heat forming the end of sleeve 16. See FIG. 2A. Sleeve flange 50 is preferably operatively secured to remote actuator 12, within a closely received slot 52 shown in FIGS. 3A and 3B. Actuator end retaining means 54 is preferably fabricated in the form of a hinged member which when secured beneath sleeve 16 resists removal of annular flange 50 from slot 52, while allowing retaining sleeve 16 to be twisted and otherwise rotated within slot 52 during assembly and use, without damage to the operative securement of the retaining sleeve 16 within slot 52.

Figure 2A:
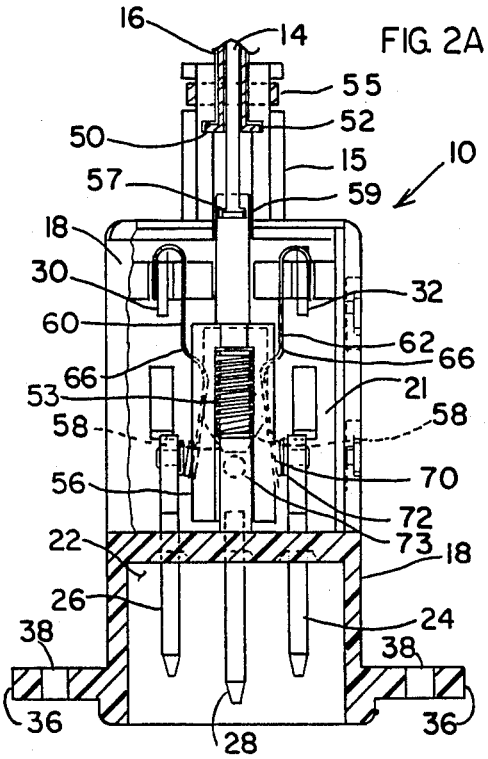
FIG. 2A is a cross-section view of the integral switch connector assembly showing the first slide member extended to the first operative position to provide electrical communication between at least one contact arm and at least one first terminal.
Figure 2B:
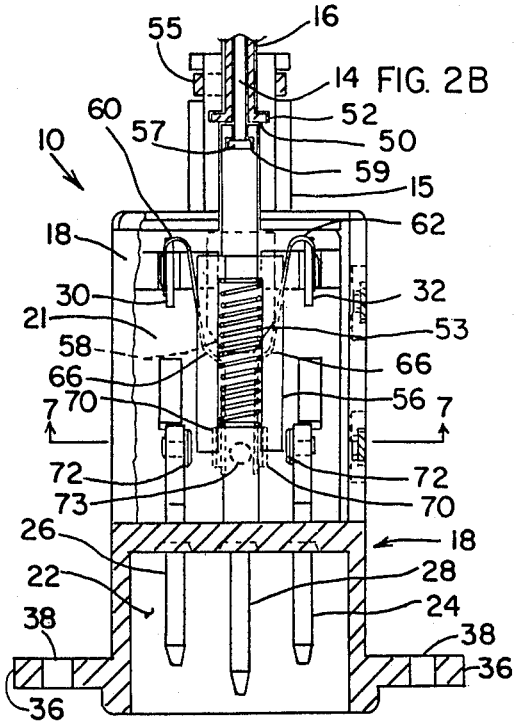
FIG. 2B is a cross-section view of the integral switch connector assembly showing the first slide member retracted to the second operative position to break electrical communication between at least one contact arm and at least one first terminal.
Figure 3A:
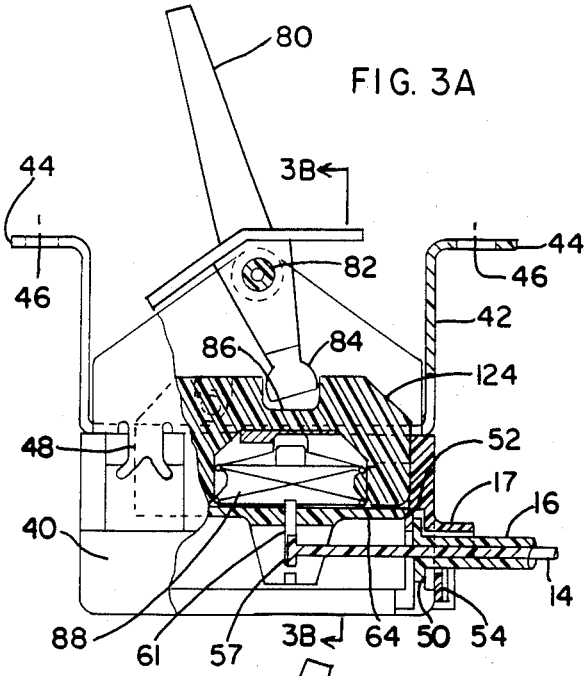
FIG. 3A is a partial cross-section side view of the preferred remote actuator assembly showing the toggle arm biased to the first operative position, and adapted for toggle arm actuation along an arc approximately parallel to movement of the actuator rod in proximity to the remote actuator.

Flange 50 of retaining sleeve end 15 is preferably operatively secured to switch housing 18 within a closely received slot 52 shown in FIGS. 2A and 2B. Switch end retaining means 55 is preferably tie wrapped or secured by other conventional fastening means. Preferably, retaining sleeve 16 is operatively secured at end 15 in a manner to allow retaining sleeve 16 to be twisted or otherwise rotated within slot 52 during assembly and use, without damage to the operative securement of the retaining sleeve 16 within slot 52.

Actuator rod 14 is preferably fabricated of a flexible non-conductive, thermoplastic material, with an external annular flange 57 formed on at least one end by heat forming the end of sleeve 14. The actuator rod flange 57 is preferably operatively secured at end 15 to first slide member 56 within a closely received slot 59. Actuator rod 14 is operatively secured at actuator end 17 within a closely received slot 61 in second slide member 64. Thus, as previously disclosed with the operative securement of retaining sleeve 16, rod 14 may be twisted and otherwise rotated within slots 59, 61 during assembly and use, without damage to the operative securement of rod 14 within slots 59, 61. Alternately, rod 14 may be secured to first or second slide member 56, 64 or sleeve 16 may be secured to switch housing 18 or actuator housing 20 by any conventional means.

Referring now to FIG. 2A, first slide member 56 is slideably disposed at least partially within switch housing 18 and is shown extended to a first operative position. A spring member 53 is preferably disposed between switch housing 18 and first slide member 56 in a manner to bias the first slide member from the first operative position to the second operative position to break electrical contact between at least one of the first terminals 24, 26 and at least one of contact arms 60, 62, should actuator rod 14 become disengaged from operative securement to the first or second slide member 64, or should actuator rod 14 otherwise fail.

First terminal 28 is preferably integral with, or secured to second terminal 34 to provide a continuous electrical communication therebetween, independent of the movement of the contact arms 60, 62 within switch housing 10.

Contact arms 60 and 62 are each secured to one of the second terminals 30 and 32 respectively, to provide continuous electrical communication therebetween. Resilient, conductive contact arms 60, 62 are formed to be positioned in spaced relation within switch housing 18 as shown in FIG. 2B, with radius 66 positioned to be biased by extending movement of first slide member 56 to first operative position shown in FIG. 2A, wherein the inclined surface 58 of first slide member 56 biases radius 66 on contact arms 60, 62 to move biased end of contact arms 60, 62 against respective terminals 26, 24 to make contact to provide electrical communication therebetween. Conductive pads 70 are preferably used on biased end of contact arms 60, 62 to contact conductive pads 72 on terminals 24, 26 to enhance conductivity between pads 70 and 72 during contact while in the first operative position.

Figure 6:
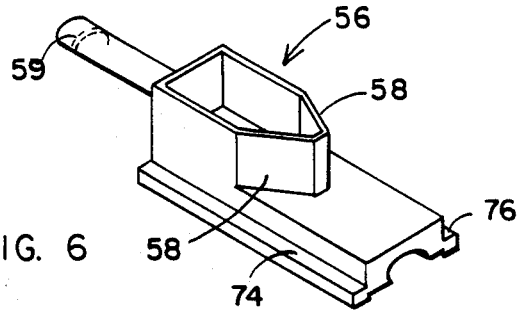
FIG. 6 is a perspective view of the first slide member showing the prefrred inclined end.

As shown in FIG. 2B, when first slide member 56 is retracted to the the second operative position, the inclined surface 58 of first slide member 56 is positioned to clear radius 66 of contact arms 60, 62, thereby releasing contact arms 60, 62 to bias away from contact with first terminals 24, 26 to break electrical communication therebetween. A non-conductive internal boss 73 is preferably positioned between contact arms 60, 62 within switch housing 18 to limit travel of the contact arms when first slide member is retracted to the second operative position to avoid one contact arm touching another. See FIG. 6.

Figure 7:
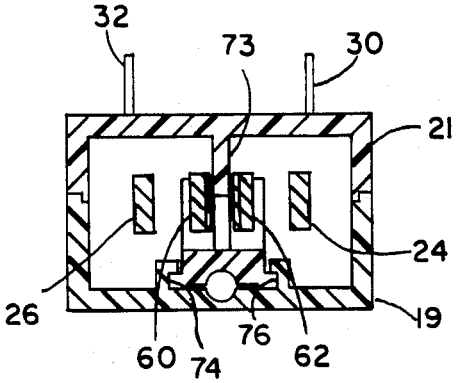
FIG. 7 is a cross sectional view of the integral switch connector assembly taken along lines 7—7 in FIG. 2B.
Figure 10:
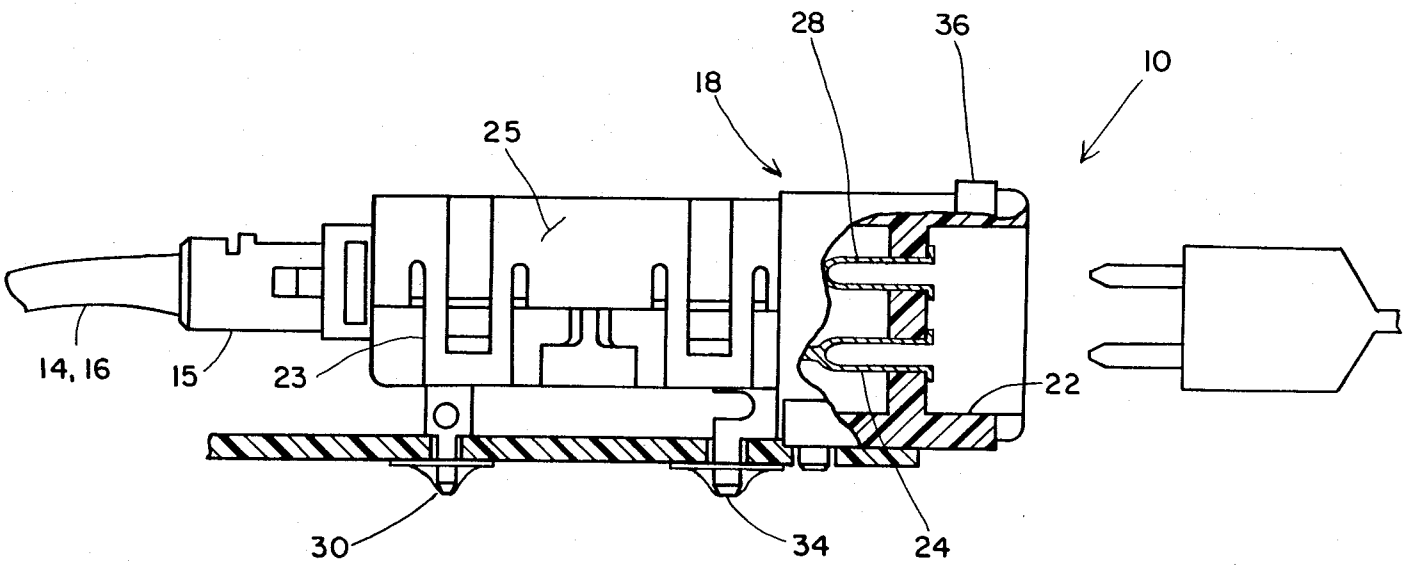
FIG. 10 is a cross sectional view of an embodiment showing the integral switch connector assembly having a male plug receptacle.

Opposed guide means 74, 76 are preferably disposed within switch housing 18 to slideably receive and guide first slide member 56 between first and second operative positions. See FIG. 7.

As shown in FIG. 8, in exploded view: second slide member 64 has a boss 102 with an internal slot 61 sized to closely receive actuator rod flange 57 therein. Second slide member 64 has a cavity 104 with ends 105, 107 sized to receive biasing means 88 therebetween. Straddling biasing means 88 is a resilient member 106 with central portion 109, and extensions 108, 110, 112 and 114, which at assembly are resiliently disposed on landings 116, 118, 120, 122 of second slide member 64, for sliding movement upon landings 116, 118, 120 and 122.

Unlocking cam member 124 has opposed guide slots 126, which are slideably received in guide aperture 128 of actuator housing 42. Unlocking cam member 124 has a groove 86 adapted to receive toggle arm end 84. At each end of unlocking cam member 124 are spaced protrusions 130, 132 which are slideably received in slots 134, 136 disposed in second slide member 64. When assembled, protrusions 130, 132 on unlocking cam member 124 selectively act against biasing means 88 as toggle arm biasing end 84 urges unlocking cam member 124 through slot 86 between first and second operative positions. The opposite end of biasing means 88 acts against one end 105, 107 of cavity 104 in second sliding member 64 to compress biasing means 88. As unlocking cam member is biased by toggle arm 80, the inclined surface 135, 137 of unlocking cam member 124 progressively acts against central portion 109 of resilient member 106 to bias extensions 108, 110, 112, 114 until the compression is sufficient to urge the central portion 109 of resilient member 106 past raised bosses 138, 140 on actuator housing 42. As resilient member 106, acting through resilient extensions 108, 110, 112, 114, is sufficiently compressed to ride over raised bosses 138, 140 on actuator housing 42, the compressed force of biasing means 88 is released, in a rapid snap-action motion, urging second sliding member 64 between first and second operative positions. Second sliding member 64 moves independently of the speed of movement of toggle arm 80. The snap action motion of second slide member 64 slideably received within housing 40, acts through boss 102 to rapidly bias actuator rod 14, whose flange end 57 is operatively secured within slot 61. The snap action is transmitted by actuator rod 14 to rod flange 51 operatively secured within first sliding member 56, slot 59 which biases contact arms 60, 62 to make or break electrical contact between first and second terminals, as previously disclosed.

Figure 3B:
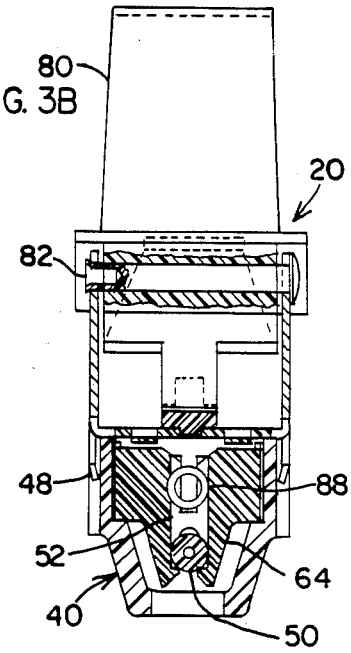
FIG. 3B is a cross sectional end view of the preferred remote actuator taken along line 3B in FIG. 3A.
Figure 4A:
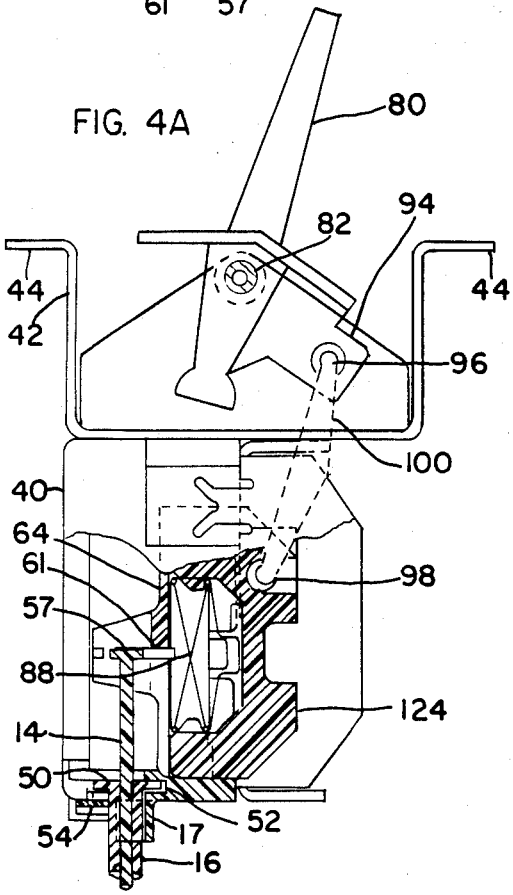
FIG. 4A is a partial cross section view of the preferred remote actuator assembly showing the toggle arm biased to the first operative position, and adapted for toggle arm actuation along an arc approximately tangent to movement of the actuator rod in proximity to the remote actuator.
Figure 4B:
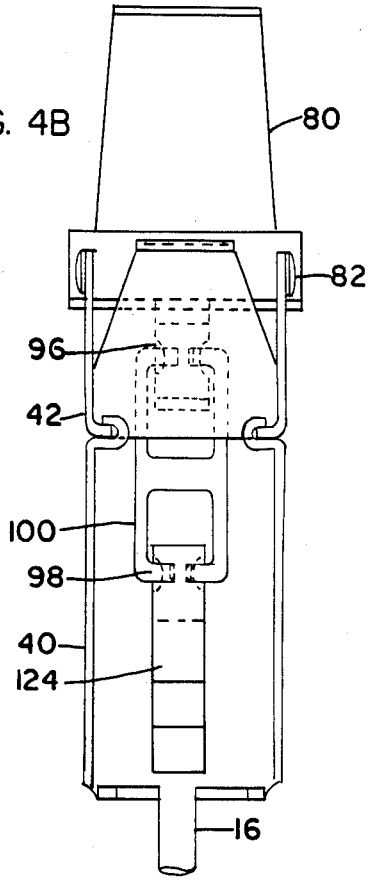
FIG. 4B is an end view of the preferred remote actuator assembly showing the link arm pivotally secured between the toggle arm and the snap action member.

Thus, toggle arm 80 may be partially biased manually without biasing second slide member, until sufficient force is expended on toggle arm 80 to trigger the snap action apparatus herein disclosed. The preferred snap action features herein disclosed, reduce the danger of inadverent switching between first and second terminals, while providing rapid snap action switching to prevent damage to the electrical equipment controlled by the switch, and further avoiding the burning or fouling of contact arms 60, 62, during higher voltage switching. The remote actuator assembly 12 shown in FIGS. 1, 4A and 3B is configured for toggle arm movement about pivotal securement 82, wherein the toggle arm movement is manually biased in an arc traversing a direction of travel approximately parallel to biasing movement of the actuator end 17 of actuator rod 14.

Where it is desirable to configure the actuator assembly 12 for toggle arm movement about pivotal securement 82, wherein the toggle arm movement is manually biased in an arc traversing a direction of travel approximately tangent to basing movement of actuator end 17 of actuator rod 14, toggle arm 80 may be adapted with a lever arm 94, as shown in FIGS. 4A and 4B.

In this configuration, lever arm 94 is preferably pivotally secured 96 to a linkage member 100 near one end. The opposite end of linkage member 100 is pivotally secured 98 to unlocking cam member 124, to transmit movement of toggle arm 80, through linkage member 100 to bias unlocking cam member 124, which acts through second slide member 64, to bias actuator rod 14 between first and second operative positions. The snap-action of second slide member 64 in tangent configuration shown in FIG. 4A remains similar to the snap action of second slide member 64 shown in FIG. 3A in a parallel configuration. Thus actuator 12 may be configured to provide a plurality of mounting positions suitable to the requirements of the desired actuator mounting configuration.

Figure 5:
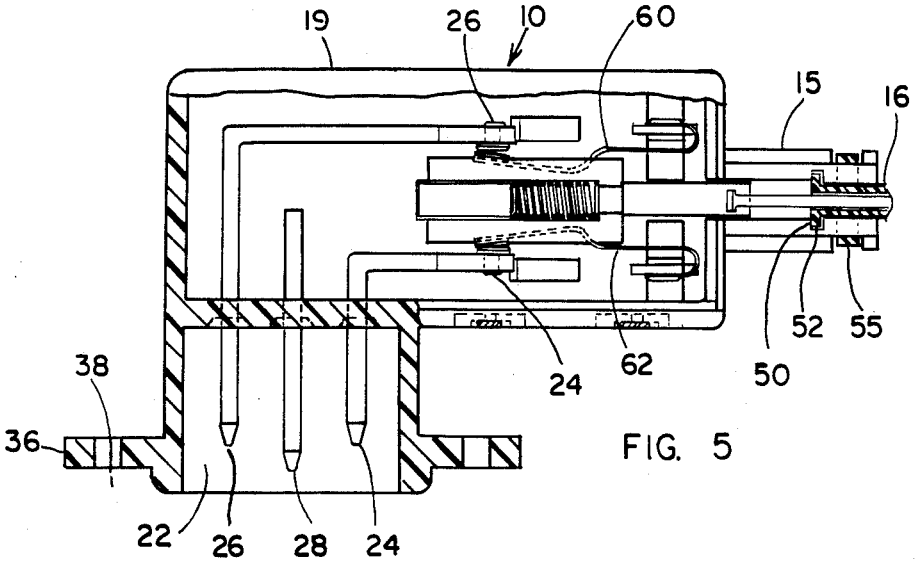
FIG. 5 is a cross sectional view of the integral switch connector assembly, configured for use with a connector mounted tangent to actuation of the first slide member.

FIG. 5 shows the integral switch connector configured for use with a connector mounted tangent to movement of actuator rod 14 at first slide member 56. Thus, it is disclosed and shown that the integral switch connector may be configured to provide a plurality of switch housing mounting configurations suitable to the requirements of the equipment in which the integral switch connector is to be installed.

An in-line removable link assembly 150 may be installed between switch assembly 10 and actuator assembly 20, as shown in FIG. 9, to provide a means to separate actuator rod 14 and actuator sleeve 14 at a remote location between actuator end 17 and switch end 15. This is particularly useful where the switch assembly 10 is installed in a remote location from the actuator assembly 20, such as within a power supply console. Removable link assembly 150 includes a link housing 152, adapted for operative securement to actuator sleeve 15.

Preferably the link end of sleeve 16 is adapted with an annular flange 50 which is closely received within slot 52 at ends 158, 160 of link housing 152, for operative securement thereto.

An aperture 156 is located within link housing 152 between ends 158, 160. Aperture 156 is sized to slidably receive rod connector 154 therein, with enough room to enable rod connector 154 to be biased within aperture 156 between first and second operative positions. See dimension "A" in FIG. 9. The link end of actuator rod 14 is preferably adapted with an annular flange 57 that is closely received within slots 59 in ends 162, 164 of rod connector 154. Any conventional means of operative securement may be used to secure rod 14 end to rod connector 154, or sleeve 16 end to link housing 152.

Thus, while the novel apparatus for an integral switch connector with remote actuator has been fully described and disclosed, numerous modifications will become readily apparent to one of ordinary skill in this art, and such adaptions and modifications are intended to be included within the scope of the following claims.

I claim:

1. An integral switch connector apparatus with remote actuator, which comprises:

(a) a switch housing with at least a portion of said switch housing formed of a non-conductive material;

(b) a first plurality of conductive terminals disposed within the non-conductive portion of said switch housing;

(c) a second plurality of conductive terminals disposed within the non-conductive portion of said switch housing;

(d) a first slide member slidably disposed at least partially within said switch housing;

(e) resilient, conductive contact arms disposed in spaced relation within said switch housing, one end of each said contact arms operatively secured to at least one of said second plurality of conductive terminals, said contact arms positioned to be biased by said first slide member to make contact with at least one of said first plurality of conductive terminals when said first slide member is extended to a first operative position to provide electrical communication therebetween, said contact arms positioned to bias away from said first plurality of conductive terminals when said first slide member is retracted to a second operative position to break electrical communication therebetween;

(f) an elongated non-conductive, flexible external retaining sleeve, one end operatively secured to said switch housing;

(g) an elongated non-conductive, flexible actuator rod slidably received within said retaining sleeve, one end of said actuator rod operatively secured to said first slide member;

(h) a remote actuator housing, the opposite end of said retaining sleeve operatively secured to said actuator housing;

(i) a second slide member disposed at least partially within said actuator housing, the opposite end of said actuator rod operatively secured to said second slide member;

(j) means to manually bias said second slide member operatively secured to said actuator rod to selectively extend and retract said first slide member to remotely bias said contact arms to make and break electrical communication between at least one of said first and second plurality of conductive terminals, wherein the speed of movement between said first and second operative positions of said contact arms is independent of the speed of movement of said means to manually bias said second slide member.

2. The apparatus of claim 1, wherein the means to manually bias said second slide member comprises:

a toggle arm, pivotally secured to said actuator housing;

the second slide member, slidably disposed in said actuator housing for travel between said first and second operative positions;

an unlocking cam member with spaced protrusions and opposed, inclined cam surfaces, said unlocking cam member slidably disposed in said actuator housing and responsive to manual actuation of said toggle arm;

a biasing means disposed between ends of said second slide member, said biasing means responsive to movement of one of said spaced protrusions of said unlocking cam member and one of said ends of said second slide member;

a resilient member, resiliently disposed between said actuator housing and said second slide member;

a raised boss centrally disposed within said actuator housing, wherein manual actuation of said toggle arm biases said unlocking cam member to compress said biasing means between one of said protrusions on said unlocking cam member and one of said ends on said second slide member until one of said inclined cam surfaces progressively compresses said resilient member to sufficiently traverse said resilient member over said raised boss, to release said compressed biasing means to rapidly traverse said second slide member between first and second operative positions, independently of the speed of movement of said toggle arm.

3. The apparatus of claim 2, wherein the toggle arm is operatively positioned to be manually biased in an arc whose principal direction of travel is approximately parallel to the movement of said second slide member between first and second operative positions within said actuator housing.

4. The apparatus of claim 2, wherein a link arm is pivotally secured at one end to said toggle arm, and is pivotally secured at its opposite end to said unlocking cam member in a manner to be operatively positioned to translate movement of said toggle arm pivotally secured to said actuator housing in an arc whose principal direction of travel is approximately tangent to the movement of said second slide member between first and second operative positions.

5. The apparatus of claim 1, wherein a spring member is disposed between said switch housing and said first slide member, to bias said first slide member from the first operative position to the second operative position to break electrical communication between at least one of said contact arms and at least one of the first plurality of conductive terminals should said actuator rod fail.

6. The apparatus of claim 1, wherein the portion of first slide member disposed within said switch housing is tapered in the area of engagement with the contact arms, and the contact arms are formed to engage the tapered area to expand at least one of said contact arms to make contact with at least one of said first plurality of conductive terminals upon extension of said first slide member to said first operative position, and to release said contact arms to break contact with said first plurality of conductive terminals upon retraction of said first slide member to said second operative position.

7. The apparatus of claim 1, wherein external terminal prongs are disposed within the switch housing to receive a female socket thereon to provide electrical connection between at least one of said first and second plurality of conductive terminals and said female socket.

8. The apparatus of claim 1, wherein internal terminal receptacles are disposed within the switch housing to receive a male plug therein to provide electrical connection between at least one of said first and second plurality of conductive terminals and said male plug.

9. The apparatus of claim 1, wherein at least one of the first and second plurality of conductive terminals extend beyond said switch housing for soldering to an external electrical connection.

10. The apparatus of claim 9, wherein at least a portion of said receptacle housing is molded of a temperature resistant thermoset plastic material to resist damage to said switch housing during soldering.

11. The apparatus of claim 1, wherein at least one of the first and second plurality of conductive terminals disposed within said switch housing is adapted to extend beyond said switch housing to be flow soldered to a substrate.

12. The apparatus of claim 1, wherein the switch housing is provided with internal opposed guide means, positioned to slidably receive and guide said first slide member, between said first and second operative positions.

13. The apparatus of claim 1, wherein the switch housing is provided with a non-conductive internal boss positioned between the contact arms to limit travel of the contact arms when said first slide member is retracted to said second operative position to avoid contact of one said contact arm with another.

14. The apparatus of claim 1, wherein the retaining sleeve is operatively secured to at least one of the switch housing and actuator housing with an external annular sleeve flange disposed at the end of said retaining sleeve and a sleeve flange slot disposed in at least one of said switch housing and said actuator housing, said annular sleeve flange sized to be closely received in said sleeve flange slot, wherein said retaining sleeve may be twisted and rotated in said slot during assembly and use without damage to the operative securement of said sleeve in said sleeve flange slot.

15. The apparatus of claim 1, wherein the retaining sleeve is fabricated of a flexible tubular plastic material, and the external annular sleeve flange is formed on at least one end of said retaining sleeve by heat forming the end of said sleeve.

16. The apparatus of claim 1, wherein the first and second slide members are operatively secured with an external annular rod flange disposed on at least one end of the actuator rod and a rod flange slot disposed in at least one of said first and second slide members, said rod flange slot sized to closely receive said rod flange, wherein said actuator rod may be twisted and rotated during assembly and use without damage to the operative securement of said rod flange in said rod flange slot.

17. The apparatus of claim 16, wherein the actuator rod is fabricated from a flexible thermoplastic material, and the external annular rod flange is formed by heat forming the annular rod flange on at least one end of said actuator rod.

18. The apparatus of claim 1, wherein at least one of said first plurality of conductive terminals is interconnected to at least one of said second plurality of conductive terminals to provide continuous electrical communication therebetween, independent of the movement of said contact arms within said switch housing.

19. The apparatus of claim 1, wherein an in-line removable link assembly is disposed along said retaining sleeve between said switch housing and said actuator housing, which comprises:

a link housing with a link aperture disposed between link ends of said link housing;

a retaining sleeve link end means, operatively secured to the link ends of said link housing;

a rod connector, slidably disposed within said link aperture, said rod connector sized for basing movement of rod connector within link housing aperture between first and second operative positions; and a rod link end means operatively secured to said rod connector, to transmit movement of said actuator rod from said means to manually bias said second slide member through said actuator rod to selectively extend and retract said first slide member located within said switch housing between first and second operative positions.

20. The apparatus of claim 1, wherein the non-conductive retaining sleeve and the non-conductive actuator rod isolate electrical interference and the hazard of electrical shock between the remote biasing means and the integral switch connector.

* * * * *